US008545579B2

(12) United States Patent
Nukumi et al.

(10) Patent No.: US 8,545,579 B2
(45) Date of Patent: Oct. 1, 2013

(54) GASIFICATION FURNACE STRUCTURE IN GASIFICATION FACILITY

(75) Inventors: Hisanori Nukumi, Tokyo (JP); Toshiyuki Suda, Tokyo (JP); Tomoya Muramoto, Tokyo (JP)

(73) Assignee: IHI Corporation, Tokyo (JP)

( * ) Notice: Subject to any disclaimer, the term of this patent is extended or adjusted under 35 U.S.C. 154(b) by 383 days.

(21) Appl. No.: 12/921,802

(22) PCT Filed: Mar. 18, 2009

(86) PCT No.: PCT/JP2009/001195

§ 371 (c)(1),
(2), (4) Date: Sep. 10, 2010

(87) PCT Pub. No.: WO2009/116274

PCT Pub. Date: Sep. 24, 2009

(65) Prior Publication Data

US 2011/0027132 A1 Feb. 3, 2011

(30) Foreign Application Priority Data

Mar. 19, 2008 (JP) ..... 2008-071233

(51) Int. Cl.
*B01J 7/00* (2006.01)
*B01J 8/18* (2006.01)
*C10B 1/00* (2006.01)

(52) U.S. Cl.
USPC ..... 48/61; 48/89; 48/101; 422/139

(58) Field of Classification Search
USPC ..... 422/139, 146; 48/74, 77, 76, 61, 48/89, 101
See application file for complete search history.

(56) References Cited

U.S. PATENT DOCUMENTS

2009/0265987 A1* 10/2009 Xu et al. ..... 48/89
2011/0120007 A1* 5/2011 Matsuzawa et al. ..... 48/61

FOREIGN PATENT DOCUMENTS

| | | |
|---|---|---|
| JP | 63-140805 | 6/1988 |
| JP | 2003-176486 | 6/2003 |
| JP | 2004-3757 | 1/2004 |
| JP | 2006-265454 | 10/2006 |
| JP | 2006-292275 | 10/2006 |
| JP | 2007 112872 | 5/2007 |
| JP | 2007-112872 | 5/2007 |
| JP | 2007 112873 | 5/2007 |
| JP | 2007 127297 | 5/2007 |

OTHER PUBLICATIONS

International Search Report mailed May 19, 2009 in PCT/JP2009/001195 filed Mar. 18, 2009.

* cited by examiner

*Primary Examiner* — Matthew Merkling
(74) *Attorney, Agent, or Firm* — Oblon, Spivak, McClelland, Maier & Neustadt, L.L.P.

(57) ABSTRACT

A gasification furnace 2 is divided into a plurality of gasification furnace units 2*a* and 2*b* each of which has an inlet 15*a*, 15*b* on a lower portion at a longitudinally upstream end in a direction of travel of raw and bed materials and has an outlet 16*a*, 16*b* on an upper portion at a longitudinally downstream end in the direction of travel. The outlet 16*a* is connected to the inlet 15*b*. The inlet 15*a* is fed with a raw material and a hot bed material from a materials separator 8. The inlet 15*b* is also fed with the hot bed material from the material separator 8. The outlet 16*b* is connected to a combustion furnace 5.

3 Claims, 4 Drawing Sheets

GASIFICATION FURNACE STRUCTURE IN GASIFICATION FACILITY

This application is a 371 of PCT/JP09/001195 filed Mar. 18, 2009, and claims benefit of Japanese application serial no. 2008-071233, filed Mar. 19, 2008.

TECHNICAL FIELD

The present invention relates to a gasification furnace structure in a gasification facility.

BACKGROUND ART

Conventionally, a gasification facility has been developed which uses as fuel a raw material such as coal, biomass or tire tips to produce a gasification gas.

FIG. 1 shows an example of a gasification facility under development comprising a gasification furnace 2 which has a fluidized bed 1 of bed material (such as silica sand or limestone) formed by vapor to gasify a raw material (such as coal, biomass or tire tips) fed to thereby produce a gasification gas and a flammable solid content, a combustion furnace 5 which is fed with the flammable solid content produced in the gasification furnace 2 together with the bed material through a guide pipe 3 and which has a fluidized bed 4 formed by fluidizing gas such as air or oxygen to burn the flammable solid content, a material separator 8 such as a hot cyclone which separates the bed material from a combustion gas guided through a combustion gas pipe 6 from the combustion furnace 5 and feeds the separated bed material through a downcomer 7 to the gasification furnace 2, a material separator 9 such as a hot cyclone which separates the bed material from a gasification gas produced in the gasification furnace 2 and a recovery receptacle 10 which recovers the bed material separated by the separator 9.

In FIG. 1, reference numeral 11 denotes a dispersion plate which allows the vapor guided into a bottom of the gasification furnace 2 to be uniformly blown up into the fluidized bed 1; 12, a partition wall which covers a part in the gasification furnace 2 connected with the guide pipe 3 in such a manner that only a lower portion of the part is opened to thereby prevent outflow of the gasification gas in the gasification furnace 2 through the guide pipe 3 into the combustion furnace 5 and prevent inflow of the fluidizing gas such as air or oxygen in the Combustion furnace 5 through the guide pipe 3 into the gasification furnace 2; 13, a dispersion plate which allows fluidizing gas guided into a bottom of the combustion furnace 5 to be uniformly blown up into the fluidized bed 4; and 14, a forced draft fan for forced feeding of the fluidized gas into the gasification and combustion furnaces 2 and 5.

In the above-mentioned gasification facility, during a normal operation, the fluidized bed 1 is formed in the gasification furnace 2 by the vapor. Feeding of a raw material such as coal, biomass or tire tips into the fluidized bed causes the raw material to be vapor-gasified to thereby produce a gasification gas and a flammable solid content. The flammable solid content produced in the gasification furnace 2 is guided through the guide pipe 3 together with the bed material into the combustion furnace 5 with the fluidized bed 4 formed by the fluidizing gas, and the flammable solid content is burned therein. The combustion gas from the combustion furnace 5 is guided through the combustion gas pipe 6 to the material separator 8 such as a hot cyclone where the bed material is separated from the combustion gas. The separated bed material is returned through the downcomer 7 to the gasification furnace 2 and is circulated.

In this respect, the bed material high-temperatured due to the combustion of the flammable solid content in the combustion furnace 5 is guided through the combustion gas pipe 6 together with the combustion gas, is separated by the material separator 8 and then is fed through the downcomer 7 to the gasification furnace 2, so that the gasification furnace 2 is kept hot and the produced gas by pyrolysis of the raw material and the raw material residue are reacted with the vapor to bring about aqueous gasification reaction [$C+H_2O=H_2+CO$] and hydrogen transfer reaction [$CO+H_2O=H_2+CO_2$] to thereby produce a flammable gasification gas such as $H_2$ or CO.

From the gasification gas produced in the gasification furnace 2, the bed material is separated by the material separator 9 such as hot cyclone. The bed material separated by the separator 9 is recovered by the recovery receptacle 10.

Incidentally, upon heat lack during a normal operation in the gasification facility, i.e., when heat for sufficient gasification of the raw material is unavailable in the gasification furnace 2, fuel such as coal, biomass or tire tips similar to the raw material fed to the gasification furnace 2 is supplementarily fed into the combustion furnace 5 for combustion so as to supplement lack of heat as shown by imaginary line in FIG. 1. Moreover, during preparative circulating preheating operation before the normal operation in the gasification facility, no raw material is fed into the gasification furnace 2, and not vapor but fluidizing air is fed to the gasification furnace 2 from below; in this state, the fuel such as coal, biomass or tire tips is fed for preheating into the combustion furnace 5 for combustion of the same as shown in imaginary line in FIG. 1, so that the bed material in the combustion furnace 5 high-temperatured due to the combustion of the fuel is guided through the combustion gas pipe 6 together with the combustion gas, is separated by the material separator 8 and is fed through the downcomer 7 to the gasification furnace 2, whereby circulating preheating is conducted in the gasification facility.

State-of-the-art technology for a gasification facility with gasification and combustion furnaces 2 and 5 as shown in FIG. 1 is disclosed, for example, in Patent Literature 1.

[Patent Literature 1] JP 2007-112872A

SUMMARY OF INVENTION

Technical Problems

With respect to the gasification facility with the gasification and combustion furnaces 2 and 5 as mentioned in the above, in order to increase throughput of coal or the like as raw material and production of the gasification gas, the gasification furnace 2 must be increased in size for example as shown in FIG. 2 to prolong dwell time of the raw material.

However, increase in size of the gasification furnace 2 as shown in FIG. 2 is disadvantageous in that length of the gasification furnace 2 increases in a direction from the raw material inlet toward the combustion furnace 5.

In order to prevent such unidirectional increase in size of the gasification furnace 2 and to make the furnace compact in size, the gasification furnace 2 may be made, for example, U-shaped as shown in FIG. 3. However, this is regarded as not so practical because of expected increase in production and repair costs due to structural difficulty in fabrication and difficulties in repair and replacement.

Moreover, in either of the gasification furnaces 2 in FIGS. 2 and 3, as the gasification reaction proceeds in the gasification furnace 2, the raw material has smaller-sized particles in diameter so that the raw material is transferred to higher level in the bed material constituting the fluidized bed 1, resulting in local increase in density of the raw material. In this manner, the raw material has increased density depending on a level in the fluidized bed 1 as the raw material is directed from an inlet side to an outlet side of the furnace; as a result, because of the fact that the gasification reaction of the raw material is an endothermic reaction, the higher the level in the fluidized bed is, the more the gasification reaction (endothermic reaction) of the raw material proceeds due to the increased density of the raw material and the more the temperature of the bed material is lowered, possibly resulting in lowered gasification efficiency due to failure of keeping a temperature condition necessary for the gasification. Furthermore, the higher the level in the fluidized bed 1 is, the more the contact area of the raw material with the vapor and bed material is decreased owing to the gasification gas produced. These are factors which may bring about conditions and environment unsuited for effective gasification reaction.

The invention was made in view of the above and has its object to provide a gasification furnace structure in a gasification facility capable of ensuring enough dwell time of a raw material without unidirectional enlargement of a gasification furnace, capable of preventing the raw material from being locally increased in density, capable of increasing throughput of the raw material and production of a gasification gas by arranging effective gasification reaction environment, and further capable of attaining simplification in structure for facilitation of repair and replacement and for reduction in fabrication and repair costs.

Solution to Problems

The invention is directed to a gasification furnace structure in a gasification facility comprising a gasification furnace which has a fluidized bed of bed material formed by vapor to gasify a raw material fed to thereby produce a gasification gas and a flammable solid content, a combustion furnace which is fed with the flammable solid content produced in the gasification furnace together with the bed material and which has a fluidized bed formed by fluidizing gas to burn said flammable solid content, and a material separator which separates the bed material from a combustion gas from the combustion furnace to feed said separated bed material to said gasification furnace, characterized in that said gasification furnace is divided into a plurality of gasification furnace units through which the raw and bed materials pass sequentially, each of said gasification furnace units having an inlet on a lower portion at a longitudinally upstream end in a direction of travel of the raw and bed materials and having an outlet on an upper portion at a longitudinally downstream end in the direction of travel of the raw and bed materials, the outlet of each upstream gasification furnace unit among the gasification furnace units being connected to the inlet of the gasification furnace unit downstream thereof, said inlet of the downstream gasification furnace unit being fed with the hot bed material from said material separator, the inlet of the gasification furnace unit arranged mostupstream among the gasification furnace units is fed with the raw material and the hot bed material from said material separator, the outlet of the gasification furnace unit arranged mostdownstream among the gasification furnace units being connected to said combustion furnace.

By the above means, the following working will be obtained.

The gasification furnace unit arranged mostupstream is fed through its inlet with the raw material and the hot bed material from the material separator. As the gasification reaction proceeds in the gasification furnace unit, the raw material has smaller-sized particles in diameter so that the raw material is transferred to higher level in the bed material constituting the fluidized bed, the raw material transferred to the higher level in the bed material being taken out together with the bed material through the outlet arranged on the upper portion, the raw and bed materials taken out and the hot bed material from the material separator being guided to the gasification furnace unit downstream thereof through the inlet arranged on the lower portion. Eventually, through the outlet of the gasification furnace unit arranged mostdownstream, the flammable solid content is guided together with the bed material to the combustion furnace.

As a result, due to the fact that the raw material has smaller-sized particles in diameter as the gasification reaction proceeds in each of the gasification furnace units, the raw material is transferred to higher level in the bed material constituting the fluidized bed; however, the raw material is adapted to be transferred to and dispersed in, in its succeeding gasification furnace unit, lower level in the bed material constituting the fluidized bed, resulting in no local increase in density of the raw material. Moreover, the hot bed material from the material separator is also guided, which keeps the temperature condition necessary for the gasification and brings about no fear of lowered gasification efficiency. Furthermore, even at higher level in the fluidized bed, the contact area of the raw material with the vapor and bed material is not decreased for the gasification gas produced. These can bring about conditions and environment suited for effective gasification reaction.

Moreover, even when the gasification furnace requires to be enlarged to prolong the dwell time of the raw material for the purpose of increasing throughput of coal or the like as raw material and production of gasification gas, the gasification furnace can be made compact in size while avoiding unidirectional enlargement of the gasification furnace. In comparison with the U-shaped gasification furnace, the respective gasification furnace units are practical because of simplification in structure for facilitation of repair and replacement and for reduction in fabrication and repair costs.

In the above gasification furnace structure in a gasification facility, the respective gasification furnace units may be rectangular parallelepipeds, which is effective for practical use because of more simplification in structure for more facilitation of repair and replacement and for reduction in fabrication and repair costs.

Advantageous Effects of Invention

A gasification furnace structure in a gasification facility according to the invention can exhibit excellent effects that enough dwell time of the raw material can be ensured without unidirectional enlargement of the gasification furnace, that the raw material can be prevented from being locally increased in density, that throughput of the raw material and production of a gasification gas can be increased by arranging effective gasification reaction environment and that simplification in structure can be attained for facilitation of repair and replacement and for reduction in fabrication and repair costs.

REFERENCE SIGNS LIST

1*a* fluidized bed
1*b* fluidized bed
2 gasification furnace
2*a* gasification furnace unit
2*b* gasification furnace unit
5 combustion furnace
7 downcomer
8 material separator
15*a* inlet
15*b* inlet
16*a* outlet
16*b* outlet
17*a* gasification gas outlet
17*b* gasification gas outlet

DESCRIPTION OF EMBODIMENT

An embodiment of the invention will be described in conjunction with the drawings.

Figure 1:
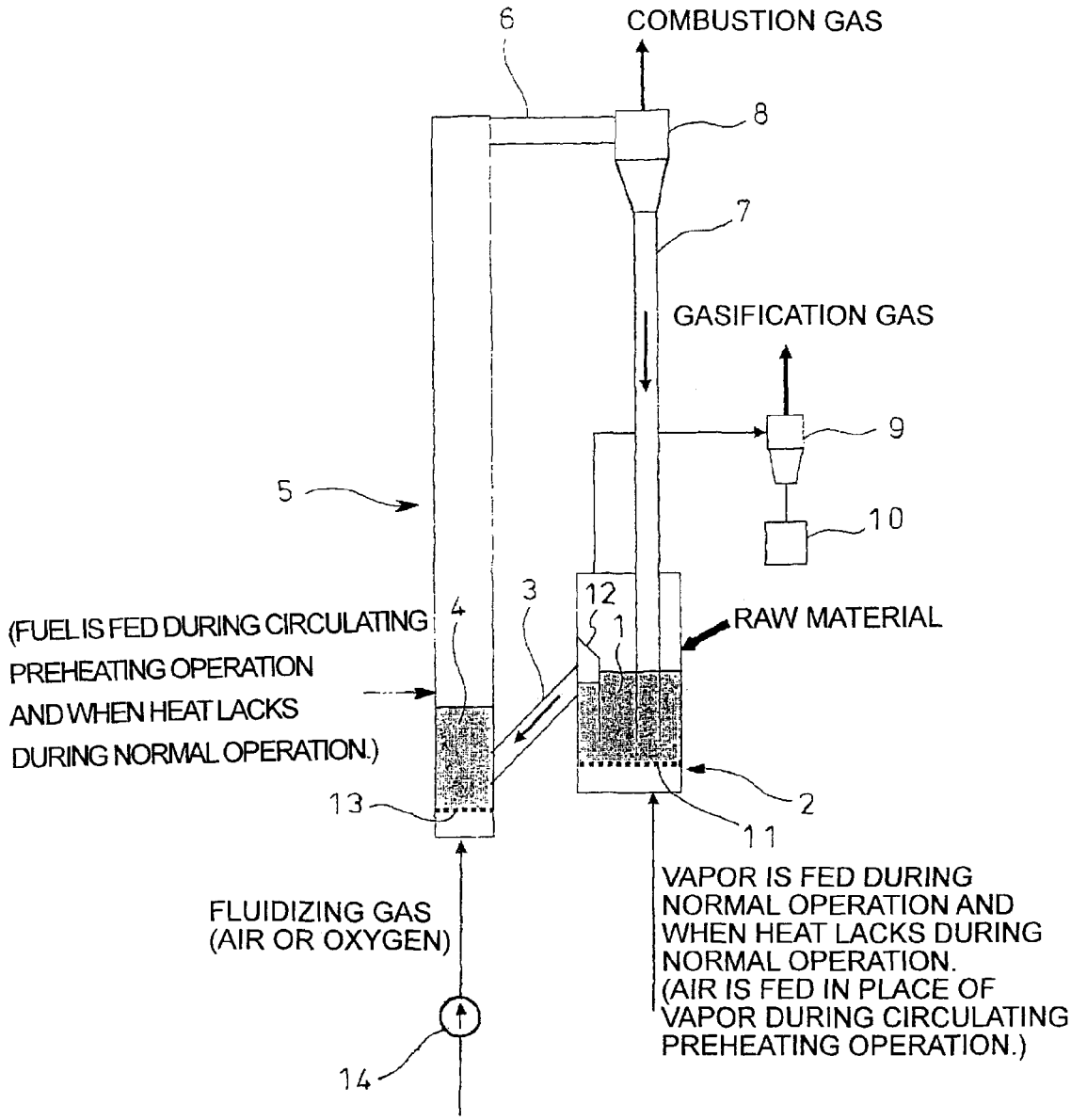
FIG. 1 is a schematic overall diagram showing an example of a gasification facility with gasification and combustion furnaces under development.
Figure 2:
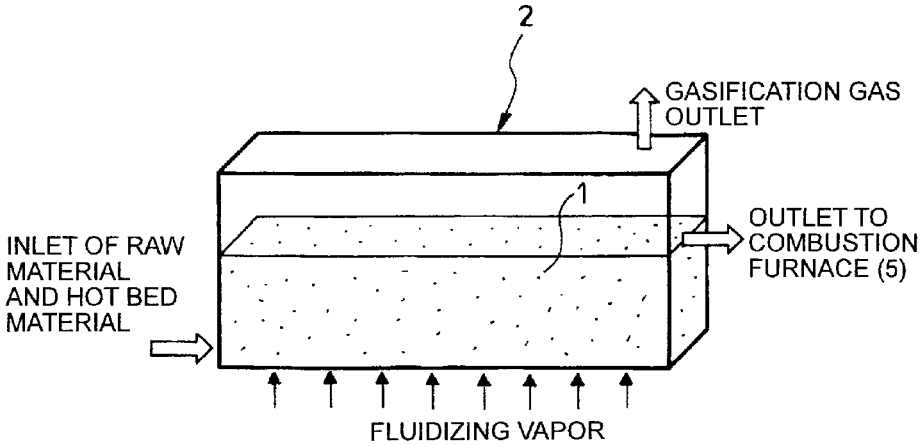
FIG. 2 is a schematic perspective view showing an example of a unidirectionally elongated gasification furnace.
Figure 3:
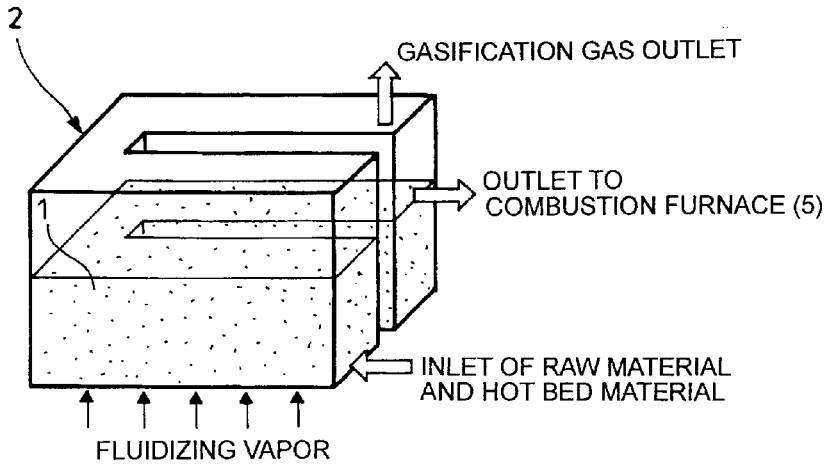
FIG. 3 is a schematic perspective view showing an example of a U-shaped gasification furnace.
Figure 4A:
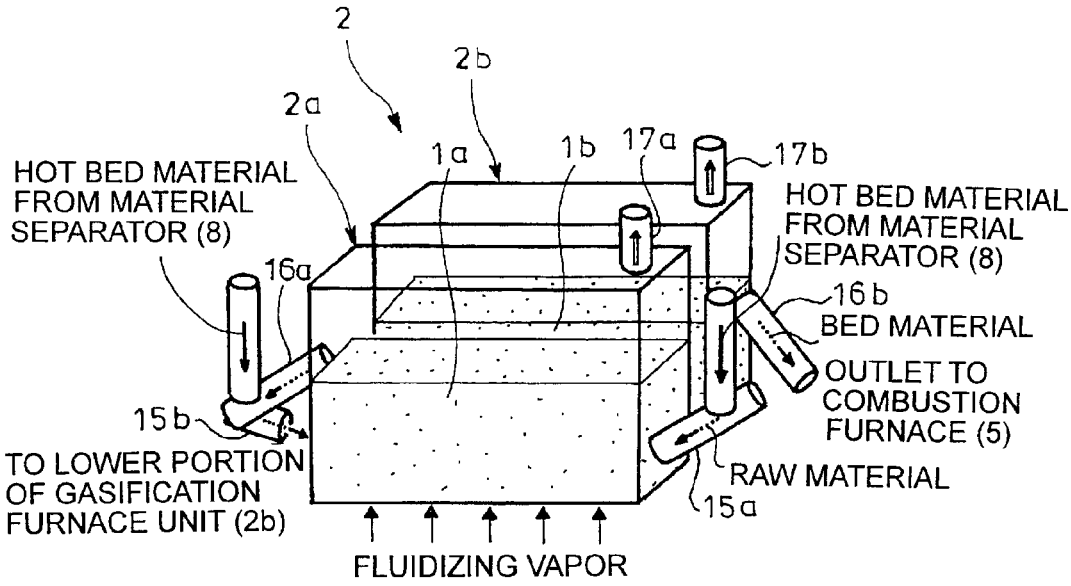
FIG. 4*a* is a schematic diagram showing an embodiment of the invention and is a schematic perspective view showing a gasification furnace comprising a plurality of (two) gasification furnace units.
Figure 4B:
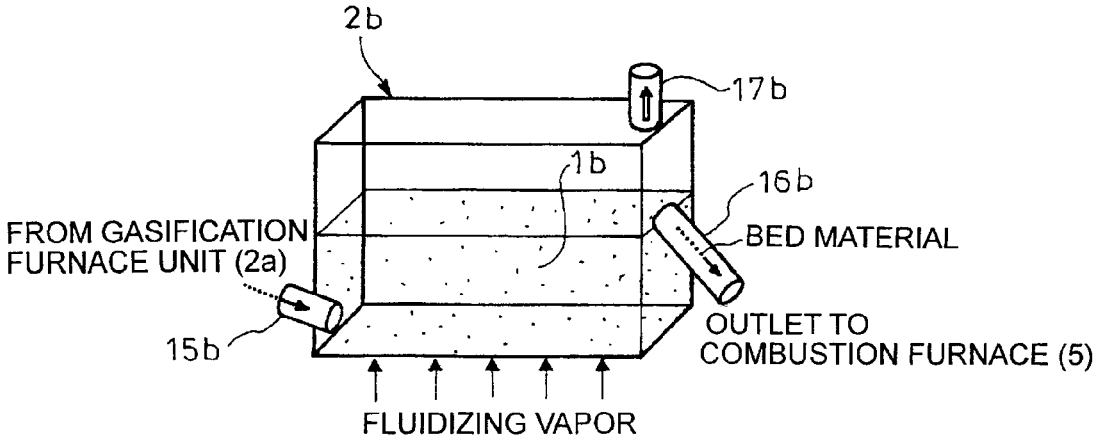
FIG. 4*b* is a schematic diagram showing the embodiment of the invention and is a schematic perspective view showing the gasification furnace unit arranged downstream.
Figure 4C:
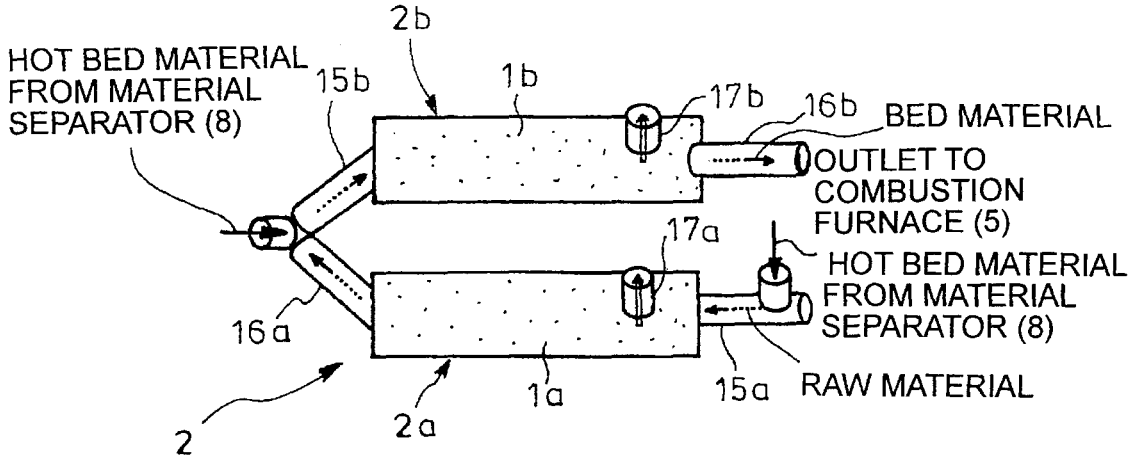
FIG. 4*c* is a schematic diagram showing the embodiment of the invention and is a schematic plan view of the gasification furnace comprising the plurality of (two) gasification furnace units.

FIGS. 4*a*-4*c* show an embodiment of the invention in which parts similar to those in FIGS. 1-3 are represented by the same reference numerals and which has a fundamental construction similar to that of the prior art shown in FIGS. 1-3. The embodiment is characteristic in that, as shown in FIGS. 4*a*-4*c*, the gasification furnace 2 is divided into a plurality of (two in the embodiment shown in FIGS. 4*a*-4*c*) gasification furnace units 2*a* and 2*b* through which raw and bed materials pass sequentially. The respective gasification furnace units 2*a* and 2*b* have their inlets 15*a* and 15*b* on lower portions at their longitudinally upstream ends in a direction of travel of the raw and bed materials, respectively. The respective gasification furnace units 2*a* and 2*b* have their outlets 16*a* and 16*b* on upper portions at their longitudinally downstream ends in the direction of travel of the raw and bed materials, respectively. Among the respective gasification furnace units 2*a* and 2*b*, the outlet 16*a* of the upstream gasification furnace unit 2*a* is connected to the inlet 15*b* of the gasification furnace unit 2*b* arranged downstream thereof; the inlet 15*a* of the gasification furnace unit 2*a* arranged upstream is fed with the raw material and the hot bed material from the material separator 8 (see FIG. 1); the inlet 15*b* of the gasification furnace unit 2*b* arranged downstream is also fed with the hot bed material from the material separator 8; and the outlet 16*b* of the gasification furnace unit 2*b* arranged downstream is connected to the combustion furnace 5 (see FIG. 1).

In the embodiment illustrated, the respective gasification furnace units 2*a* and 2*b* are rectangular parallelepipeds.

In FIGS. 4*a*-4*c*, reference numerals 1*a* and 1*b* denote fluidized beds formed in the gasification furnace units 2*a* and 2*b*, respectively; and 17*a* and 17*b*, gasification gas outlets on upper surfaces of the gasification furnace units 2*a* and 2*b*, respectively. Gasification gas produced in the fluidized beds 1*a* and 1*b* of the gasification furnace units 2*a* and 2*b* is taken out through the gasification gas outlets 17*a* and 17*b*, respectively.

The gasification furnace 2 may be divided not only into two gasification furnace units 2*a* and 2*b*, but also into three or more gasification furnace units. When the gasification furnace 2 is divided into three or more gasification furnace units, the inlet of the gasification furnace unit arranged mostupstream is fed with the raw material and the hot bed material from the material separator 8; with respect to the gasification furnace unit or units arranged intermediately, the outlet of the or each gasification furnace unit arranged upstream is connected to the inlet of the gasification furnace unit arranged downstream thereof, the inlet of the downstream gasification furnace unit being fed with the hot bed material from the material separator 8; and the outlet of the gasification furnace unit arranged mostdownstream is connected to the combustion furnace 5.

Next, mode of operation of the above embodiment will be described.

The gasification furnace unit 2*a* arranged upstream is fed through its inlet 15*a* with the raw material and the hot bed material from the materials separator 8. As the gasification reaction proceeds in the gasification furnace unit 2*a*, the raw material has smaller particle diameters so that the raw material is transferred to higher level in the bed material constituting the fluidized bed 1*a*, the raw material transferred to the higher level in the bed material being taken out together with the bed material through the outlet 16*a* at the upper portion. The raw and bed materials taken out and the hot bed material from the material separator 8 are guided through the inlet 15*b* at the lower portion into the fluidized bed 1*b* of the gasification furnace unit 2*b* arranged downstream thereof. Eventually, the flammable solid content is guided together with the bed material to the combustion furnace 5 through the outlet 16*b* of the gasification furnace unit 2*b* arranged downstream.

As a result, due to the fact that the raw material has smaller-sized particles in diameter as the gasification reaction proceeds in each of the gasification furnace units 2*a* and 2*b*, the raw material is transferred to higher level in the bed material constituting the fluidized bed 1*a*; however, the raw material is adapted to be transferred to and dispersed in, in its succeeding gasification furnace unit 2*b*, lower level in the bed material constituting the fluidized bed 1*b*, resulting in no local increase in density of the raw material. Moreover, the hot bed material from the material separator 8 is also guided, which keeps the temperature condition necessary for the gasification and brings about no fear of lowered gasification efficiency. Furthermore, even at higher level in the fluidized bed 1*a*, the contact area of the raw material with the vapor and bed material is not decreased for the gasification gas produced. These can bring about conditions and environment suited for effective gasification reaction.

Moreover, even when the gasification furnace 2 requires to be enlarged to prolong the dwell time of the raw material for the purpose of increasing throughput of coal or the like as raw material and production of gasification gas, the gasification furnace 2 can be made compact in size while avoiding unidirectional enlargement of the gasification furnace 2. In comparison with the U-shaped gasification furnace 2 (see FIG. 3), the respective gasification furnace units 2*a* and 2*b*, which are rectangular parallelepipeds as shown in the embodiment, which is effective for practical use because of more simplification in structure for more facilitation of repair and replacement and for reduction in fabrication and repair costs.

Thus, enough dwell time of the raw material can be ensured without unidirectional enlargement of the gasification furnace 2. The raw material can be prevented from being locally increased in density. Throughput of the raw material and production of a gasification gas can be increased by arranging effective gasification reaction environment. Furthermore, simplification in structure can be attained for facilitation of repair and replacement and for reduction in fabrication and repair costs.

It is to be understood that a gasification furnace structure in a gasification facility according to the invention is not limited to the above embodiment and that various changes and modifications may be made without departing from the scope of the invention.

The invention claimed is:

1. A gasification furnace structure in a gasification facility comprising a gasification furnace which has a fluidized bed of bed material formed by vapor to gasify a raw material fed to thereby produce a gasification gas and a flammable solid content, a combustion furnace which is fed with the flammable solid content produced in the gasification furnace together with the bed material and which has a fluidized bed formed by fluidizing gas to burn said flammable solid content, and a material separator which separates the bed material from a combustion gas from the combustion furnace to feed said separated bed material to said gasification furnace, characterized in that said gasification furnace is divided into a plurality of gasification furnace units formed in rectangular parallelepipeds through which the raw and bed materials pass sequentially in a longitudinal direction extending horizontally of the rectangular parallelepipeds, each of said gasification furnace units being horizontally arranged longitudinal of said gasification furnace units, each of said gasification furnace units having an inlet on a lower portion at a longitudinally upstream end in a direction of travel of the raw and bed materials and having an outlet on an upper portion at a longitudinally downstream end in the direction of travel of the raw and bed materials, the outlet of each upstream gasification furnace unit among the gasification furnace units being connected to the inlet of the gasification furnace unit downstream thereof, said inlet of the downstream gasification furnace unit being fed with the hot bed material from said material separator, the inlet of the gasification furnace unit arranged mostupstream among the gasification furnace units is fed with the raw material and the hot bed material from said material separator, the outlet of the gasification furnace unit arranged most-downstream among the gasification furnace units being connected to said combustion furnace.

2. A gasification furnace structure in a gasification facility as claimed in claim 1 comprising three or more of gasification furnace units.

3. A gasification furnace structure in a gasification facility as claimed in claim 1 comprising two gasification furnace units.

* * * * *